US011225808B2

(12) United States Patent
Marais

(10) Patent No.: US 11,225,808 B2
(45) Date of Patent: Jan. 18, 2022

(54) EMERGENCY RESTORATION SYSTEM AND METHOD

(71) Applicant: Electric Power Research Institute, Inc., Charlotte, NC (US)

(72) Inventor: Jean-Pierre Henri Marais, Concord, NC (US)

(73) Assignee: Electric Power Research Institute, Inc., Charlotte, NC (US)

( * ) Notice: Subject to any disclaimer, the term of this patent is extended or adjusted under 35 U.S.C. 154(b) by 0 days.

(21) Appl. No.: 16/871,212

(22) Filed: May 11, 2020

(65) Prior Publication Data

US 2021/0348415 A1 Nov. 11, 2021

(51) Int. Cl.

| | |
|---|---|
| ***E04H 12/18*** | (2006.01) |
| ***E04H 12/20*** | (2006.01) |
| ***E04H 12/34*** | (2006.01) |
| ***H01Q 1/24*** | (2006.01) |
| ***H01Q 1/12*** | (2006.01) |
| ***H01Q 1/08*** | (2006.01) |

(52) U.S. Cl.

CPC ..... *E04H 12/187* (2013.01); *E04H 12/20* (2013.01); *E04H 12/34* (2013.01); *H01Q 1/08* (2013.01); *H01Q 1/1235* (2013.01); *H01Q 1/246* (2013.01)

(58) Field of Classification Search

CPC ..... E04H 12/18; E04H 12/185; E04H 12/187; E04H 12/10; E04H 12/20; E04H 12/34; H01Q 1/1235; H01Q 1/08; H01Q 1/246

See application file for complete search history.

(56) References Cited

U.S. PATENT DOCUMENTS

| | | | | |
|---|---|---|---|---|
| 10,907,376 | B1 * | 2/2021 | Bonilla | E04C 3/04 |
| 2004/0045226 | A1 * | 3/2004 | Dehlsen | E04H 12/34 52/71 |
| 2005/0095130 | A1 * | 5/2005 | Duguet | E04H 12/187 416/142 |
| 2007/0175134 | A1 * | 8/2007 | Christenson | E04H 12/187 52/292 |
| 2011/0283640 | A1 * | 11/2011 | Miller | E04H 12/10 52/292 |
| 2012/0007365 | A1 * | 1/2012 | Harrison | E04H 3/10 290/55 |

(Continued)

FOREIGN PATENT DOCUMENTS

| | | | | |
|---|---|---|---|---|
| EP | 2133703 | A1 * | 12/2009 | G01R 31/58 |
| WO | WO-02056411 | A2 * | 7/2002 | E04H 5/02 |

OTHER PUBLICATIONS

800-Series ERS first made available on Sep. 2015, retrieved from Internet Website <https://lindsey-usa.com/ers/ > on Nov. 11, 2020).

(Continued)

*Primary Examiner* — Jessie T Fonseca

(74) *Attorney, Agent, or Firm* — Trego, Hines & Ladenheim, PLLC; Brandon Trego; Jonathan Hines

(57) ABSTRACT

An emergency restoration system is disclosed. The emergency restoration system including a base and a tower pivotally connected to the base. The tower including at least one tower section and at least one insulated tower section pivotally connected to the at least one tower section, the insulated tower section including at least one insulator pivotally connected thereto.

3 Claims, 10 Drawing Sheets

(56) References Cited

U.S. PATENT DOCUMENTS

| | | | | |
|---|---|---|---|---|
| 2015/0295392 | A1* | 10/2015 | Ma | H02G 7/05 174/45 R |
| 2017/0254106 | A1* | 9/2017 | Bruinsma | E04H 12/187 |
| 2018/0274258 | A1* | 9/2018 | Newman | H01Q 1/10 |
| 2019/0093382 | A1* | 3/2019 | Sauber | B60P 3/00 |
| 2019/0356035 | A1* | 11/2019 | Dominguez | E04H 12/20 |

OTHER PUBLICATIONS

600L-Series ERS first made available on Jun. 2014, retrieved from Internet Website <https://lindsey-usa.com/ers/ > on Nov. 11, 2020).
1070-Series ERS first made available on Sep. 2019, retrieved from Internet Website <https://lindsey-usa.com/ers/ > on Nov. 11, 2020).
Components of an SBB Tower first made available on 2017, retrieved from Internet Website <https://www.sbb.ca/emergency-towers/tower-components-and-technical-specifications> on Nov. 11, 2020).
Tower Solutions Tower Installation first made available on Jan. 9, 2015, retrieved from Internet Website <https://www youtube.com/watch?v=ZRumYzdlkZl&app=desktop> on Dec. 4, 2020.
Emergency Restoration System Flexible Transmission System on Dec. 3, 2017, retrieved from Internet Website <https://www.dnvgl.com/videos/emergency-restoration-system-151351> on Dec. 4, 2020.
BB Emergency Restoration System (ERS) Installation first made available on Jan. 8, 2020, retrieved from Internet Website <https://www.youtube.com/watch?v=x4qwExZN8v0> on Dec. 4, 2020.

* cited by examiner

EMERGENCY RESTORATION SYSTEM AND METHOD

BACKGROUND OF THE INVENTION

This invention relates generally to an emergency restoration system and method, and more particularly to a rapid response emergency tower with improved safety and decreased installation times.

The rate of outage events on overhead lines in North America has increased significantly in recent years. Publicly available outage data, collected by the Department of Energy (database of over 2000 outage events), reveals an increase of incidents from 30 events in 2000 to 142 in 2016. The annual data is erratic, but the average trend reflects a 10% per annum increase in outage events.

In recent years, extreme weather events have been prevalent, sometimes resulting in sustained outages. For example, following hurricanes Irma and Maria in September 2017, Puerto Rico experienced power outages of longer than 6 months. When power lines fail, whether by extreme weather, accidental impact, or sabotage there is a pressing need to restore power as soon as possible.

To restore powerlines rapidly, one of the primary methods currently used involves the construction of a temporary bypass, which enables power to be restored quickly while permanent restoration takes place. This normally entails the use of wood poles or purpose made Emergency Restoration Systems (ERS).

While wood pole lines have been used to restore and build temporary bypasses in a number of instances (and remain an effective emergency structure choice at voltages below 220 kV), purpose made ERS are particularly affective at rapid restoration of transmission lines from 220 kV and above.

Currently, a number of commercial ERS towers are available. ERS structures are typically modular structures, whose building elements may be configured into suspension, angle strain, running angle or dead-end structures. They are typically shipped in containers or on trailers. Containerized ERS towers contain all material, hardware and insulation to construct a complete foundation and tower rapidly. A large portion of the time saving is achieved by shipping a single container containing all required components, thus solving the logistical issues with material collation and deployment.

A typical 500 kV ERS tower can be assembled and erected in 5 hours (including foundation installation) by an experienced team, but construction periods of a full workday per tower are more typical. The longest portion of time is usually consumed by foundation construction.

Accordingly, there is a need for an ERS tower with improved safety and decreased installation times.

BRIEF SUMMARY OF THE INVENTION

This need is addressed by providing an Emergency Restoration System which will allow radically decreased restoration times of failed transmission structures in the 220 kV to 500 kV voltage range, with the added advantage of improved safety.

According to an aspect of the technology described herein, an emergency restoration system includes a base; and a tower pivotally connected to the base, the tower including at least one tower section and at least one insulated tower section pivotally connected to the at least one tower section, the insulated tower section including at least one insulator pivotally connected thereto.

According to another aspect of the technology described herein, a method of erecting an emergency restoration system, the emergency restoration system including a base and a tower formed of a plurality of tower sections and at least one insulating tower section, each of the plurality of tower sections being pivotally connected to an adjacent tower section and the at least one insulating tower section being pivotally connected to at least one of the plurality of tower sections such that in a stored position, the plurality of tower sections and at least one insulated tower section are stacked on the base and, in a use position, the plurality of tower sections and at least one insulated tower section form a linear, upright tower, includes the steps of: delivering the emergency restoration system to a location where the emergency restoration system is needed; placing the base at the location; using a lifting device to unstack and move the plurality of tower sections and at least one insulated tower section into the use position to form the linear, upright tower; moving an insulator pivotally connected to the at least one insulated tower section to a use position; and stabilizing the tower in position.

BRIEF DESCRIPTION OF THE DRAWINGS

The invention may be best understood by reference to the following description taken in conjunction with the accompanying drawing figures, in which.

DETAILED DESCRIPTION OF THE INVENTION

Figure 1:
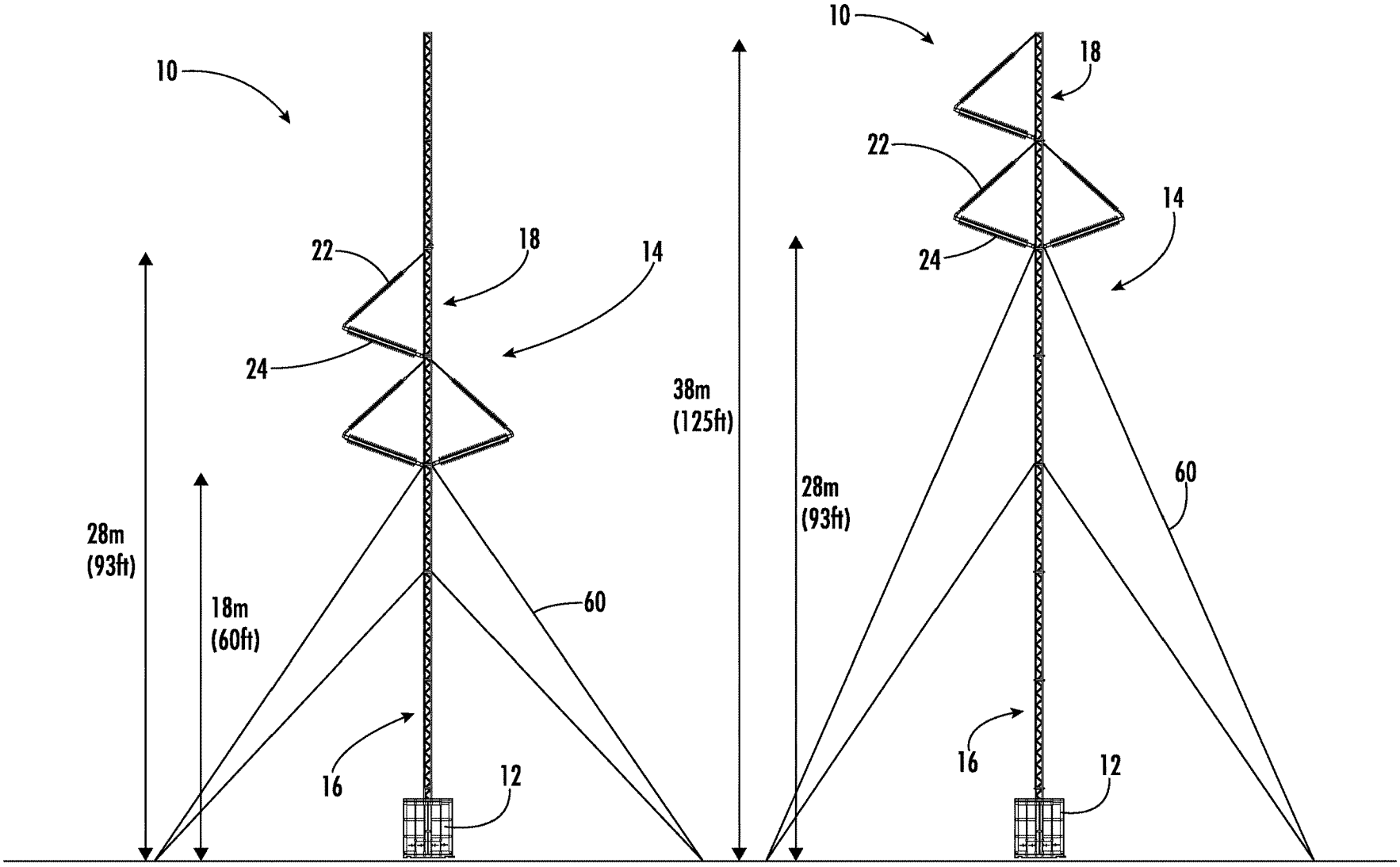
FIG. 1 shows two different height emergency restoration systems according to an embodiment of the invention.
Figure 3:
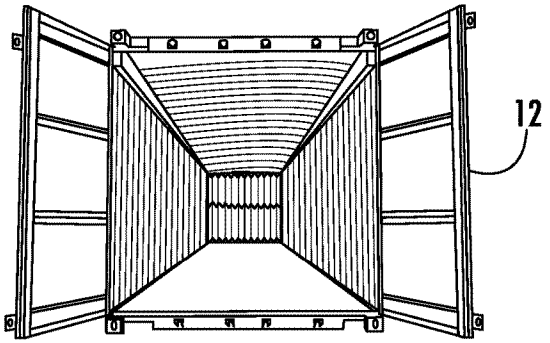
FIGS. 2-5 show components of the emergency restoration system of FIG. 1.
Figure 2:
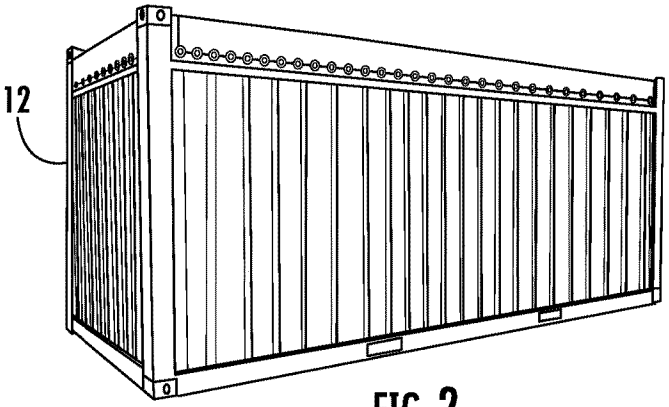
Figure 4:
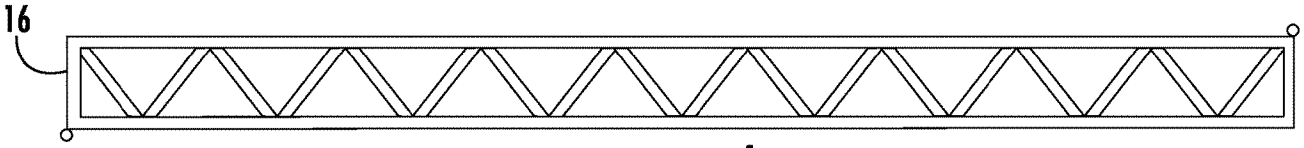

Referring to the drawings wherein identical reference numerals denote the same elements throughout the various views, FIG. 1 illustrates an erected emergency restoration system (ERS) 10. The ERS 10 is designed to be erected quickly and safely to enable power utilities to replace a failed 500 kV transmission structure in approximately 90 minutes.

Figure 6:
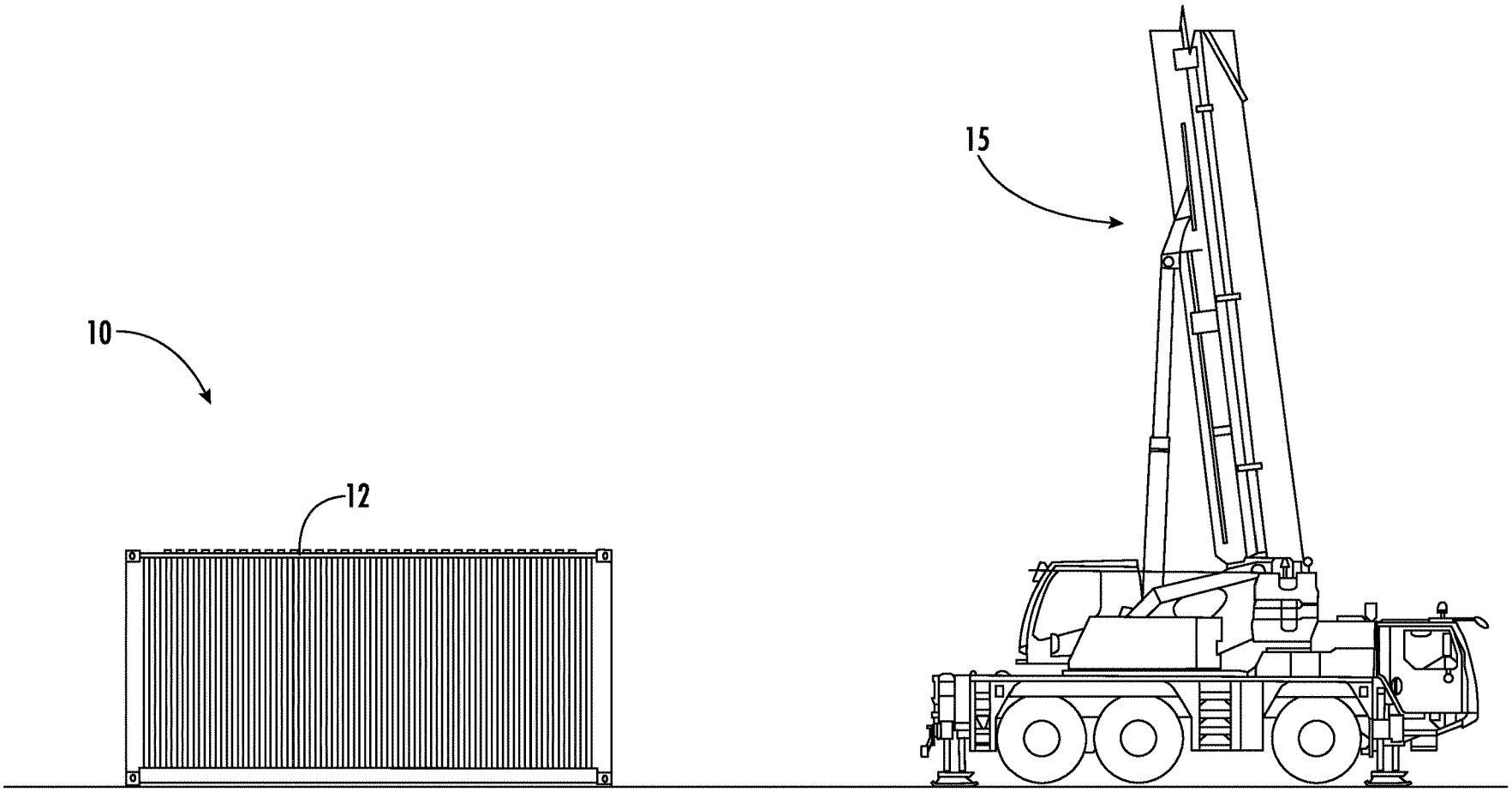
FIGS. 6-13 illustrate a method of erecting the emergency restoration system of FIG. 1.
Figure 7:
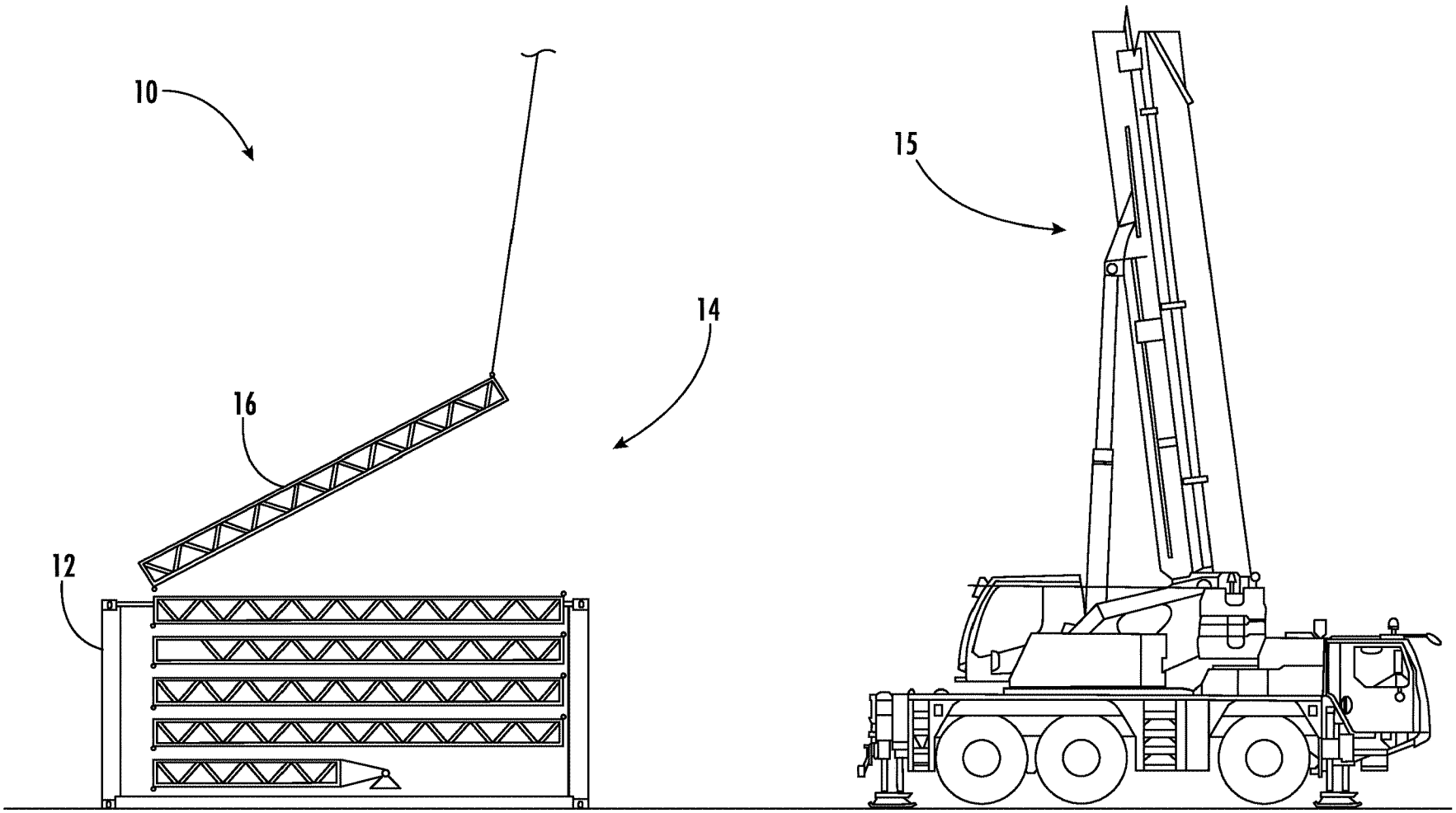
Figure 8:
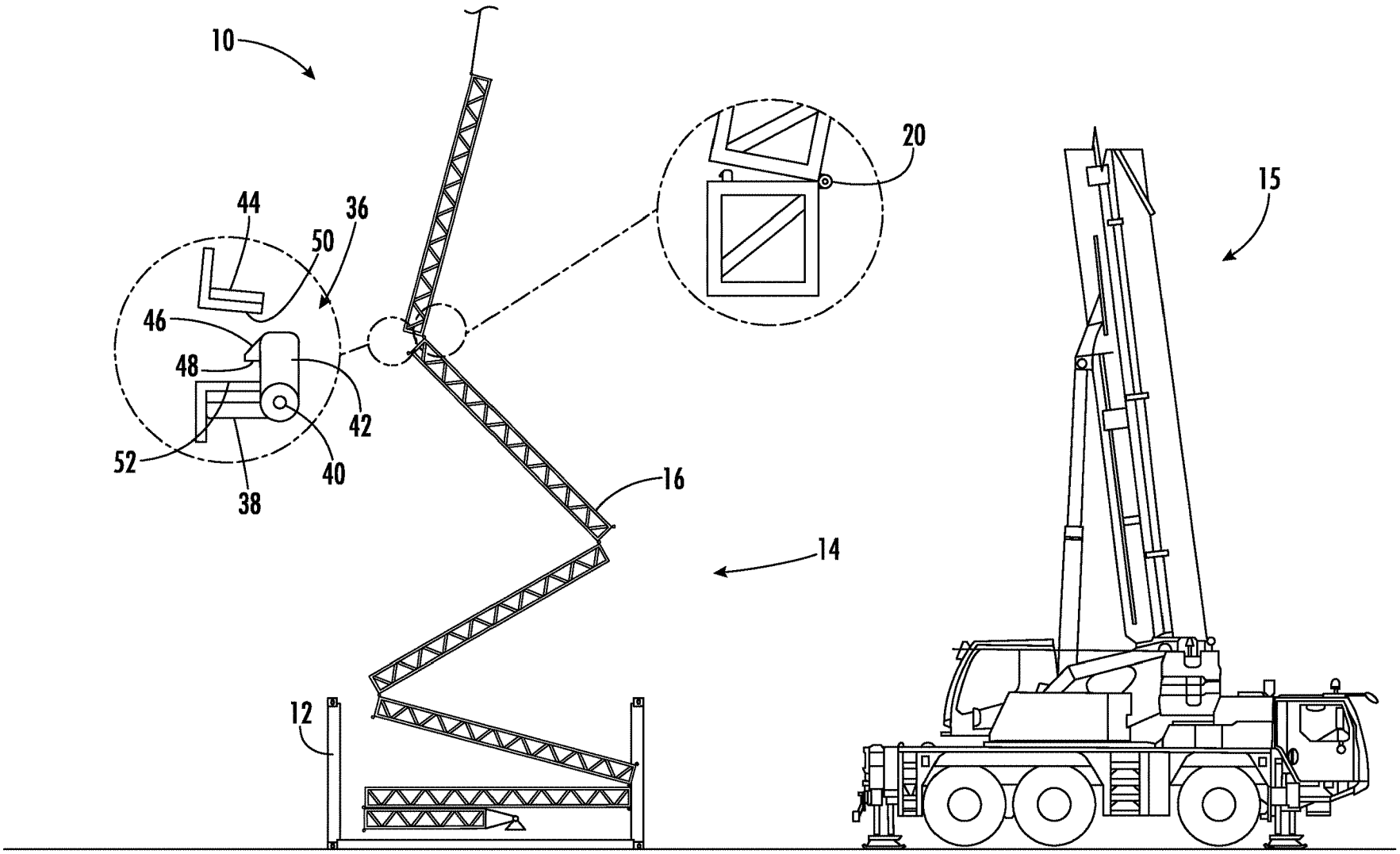
Figure 9:
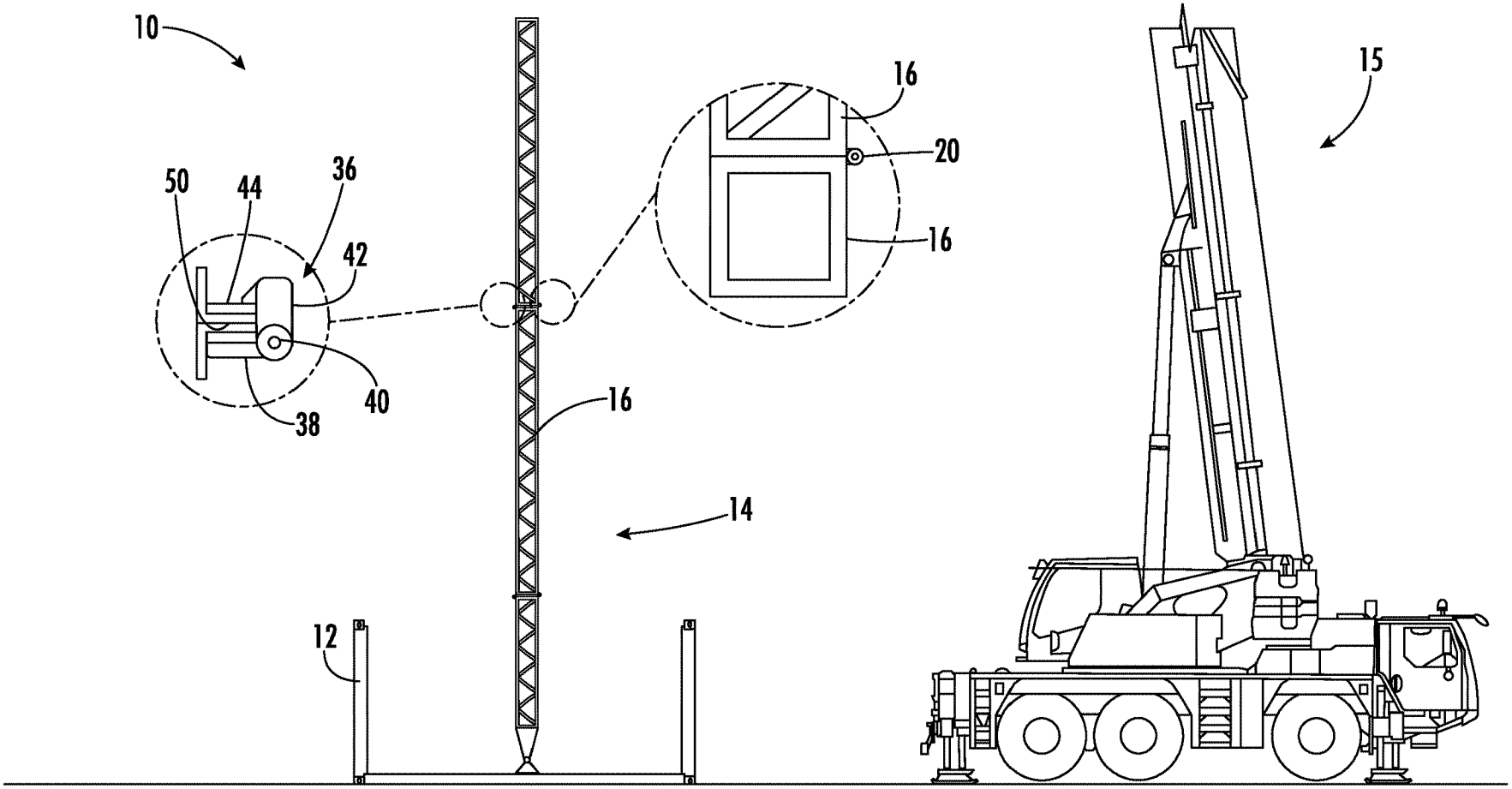

As shown, the ERS provides a complete power transmission structure and includes a base 12 and a tower 14 pivotally connected (see FIG. 6) to the base 12. As illustrated in FIGS. 2-5, the tower 14 includes one or more tower sections 16 and one or more insulated tower sections 18. The tower sections 16 and insulated tower sections 18 are pivotally connected via a hinge 20 (see FIG. 7) to allow the sections to stack upon one another onto the base 12 for transport. As shown, the base 12 is a shipping container with an open and/or removable top to allow the tower sections 16 and insulated tower sections 18 to be pulled therefrom; however, it should be appreciated that other suitable bases may be used.

Figure 5:
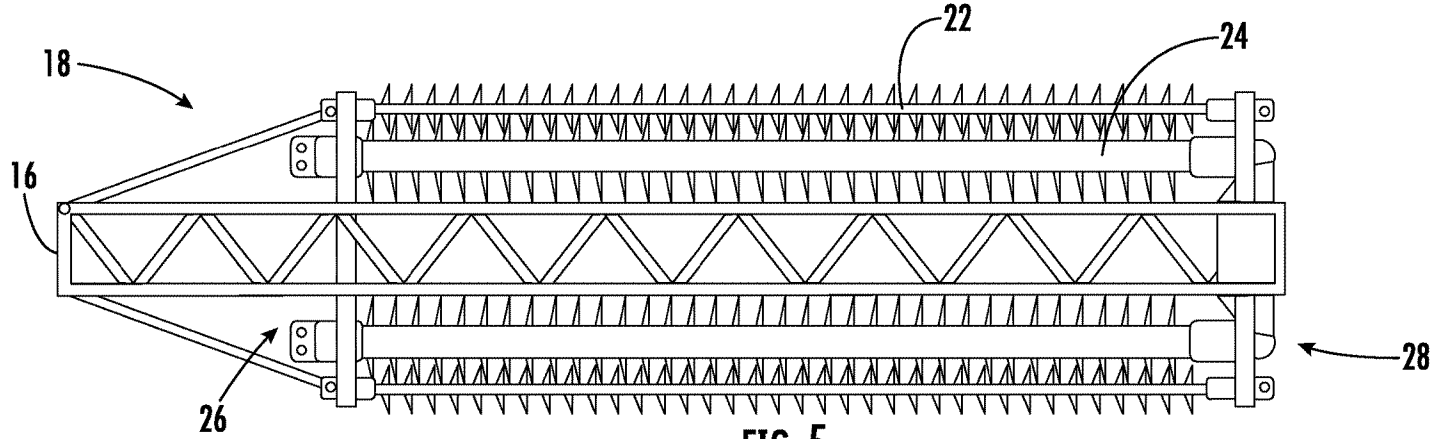

The tower sections 16 and insulated tower sections 18 have a truss design and may be formed of any suitable material. As illustrated in FIG. 5, the insulated tower section 18 includes insulators 22 and 24 pivotally connected to opposing ends 26 and 28 of a tower section 16 and are configured to be connected together at free ends 30 and 32 of the insulators 22 and 24 (see FIGS. 10 and 11). The tower sections 16 and insulated tower sections 18 are modular and allow for different configurations and tower heights to be constructed. The width and length of each of the sections 16 and 18 are selected to allow stacking of 6 to 8 sections in a standard 20 ft, "high-cube" container; however, any suitable and/or desired width and length of each section may be used.

Referring to FIGS. 6-13, the method of erecting the ERS 10 is as follows:

1. The ERS 10 is delivered to site, and offloaded at the exact location where a tower 14 is needed:

2. The tower 14 does not need to be removed from the base 12, or pre-assembled on site, since the base 12 is placed on the desired tower location. The tower 14 is lifted by crane 15 (or other lifting device) out of the base 12.

3. As the tower 14 is lifted, the tower sections 16 and insulated tower sections 18 unstack and begin to erect into a vertical tower. As shown, the hinges 20 interconnect each of the sections 16 and 18. As adjacent sections 16 or 18 align, they are locked together by a spring-loaded connector 36 (see FIGS. 7 and 8). The purpose of the connector 36 is to provide additional stability to the tower 14 during the erection sequence. Each of the connectors 36 include a base 38, a spring-loaded hinge 40, and a hook 42 to grasp onto a surface 44 of an upper adjacent tower section 16. As illustrated, the hook 42 includes a sloped portion 46 and a flat portion 48. As the upper adjacent tower section 16 aligns with a lower adjacent tower section 16, a bottom surface 50 of the upper adjacent tower section 16 contacts the sloped portion 46 of the hook 42 and pushes the hook 42 back or into an open position. Once the bottom surface 50 contacts an upper surface 52 of the lower adjacent tower section 16, the hook 42 snaps back via the spring-loaded hinge 40 into a closed position where the flat portion 48 engages surface 44 to interlock the tower sections.

Figure 10:
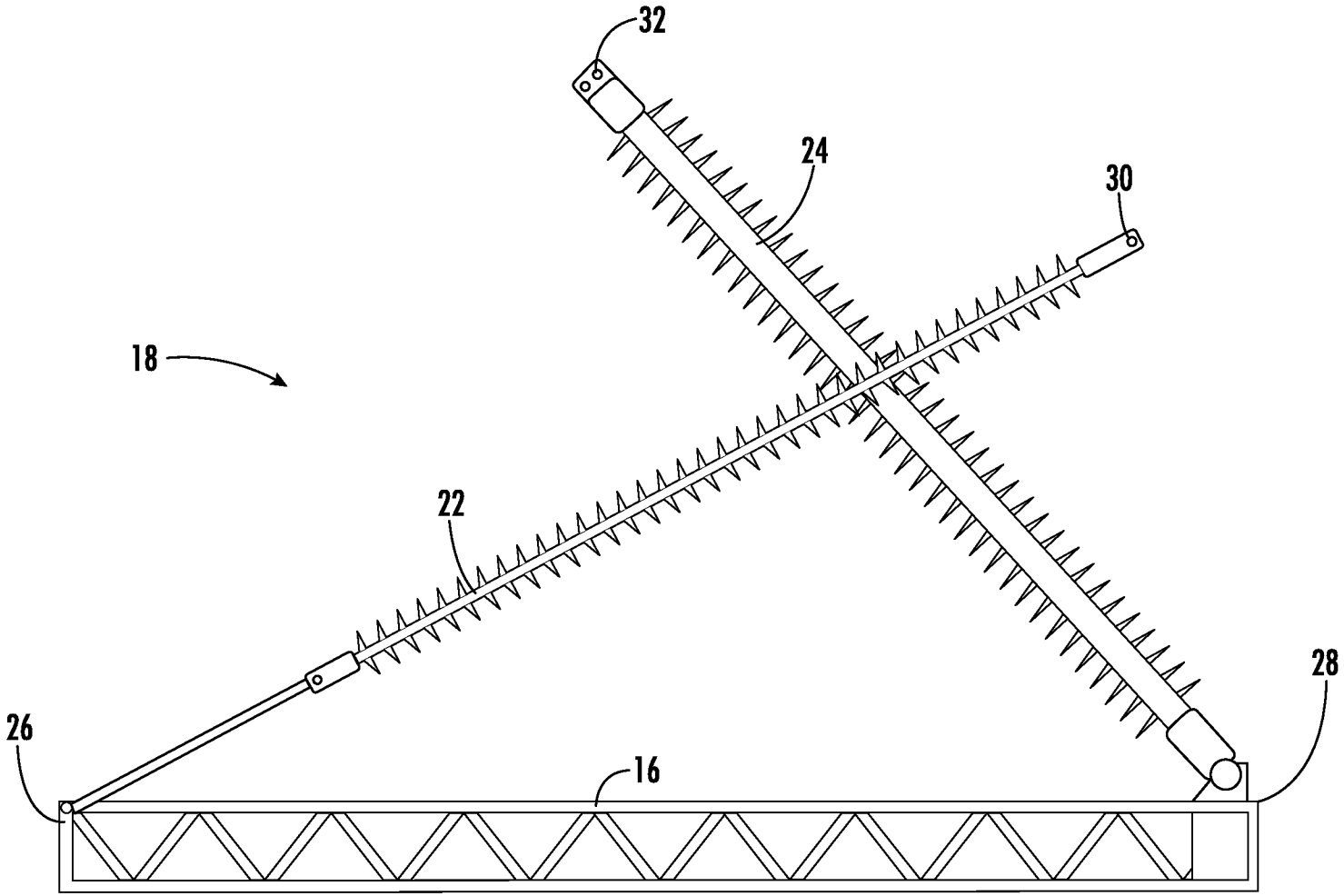
Figure 11:
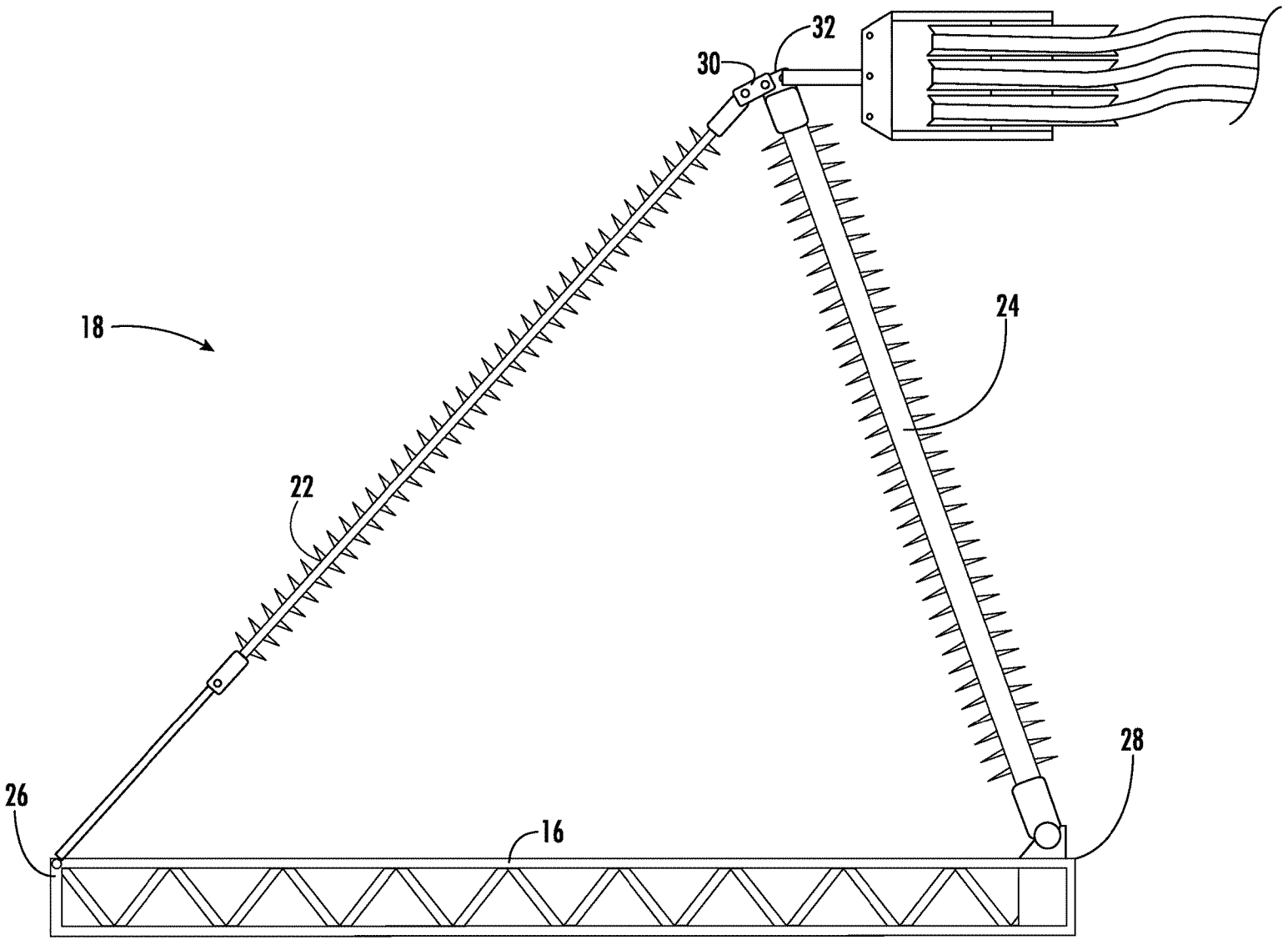
Figure 12:
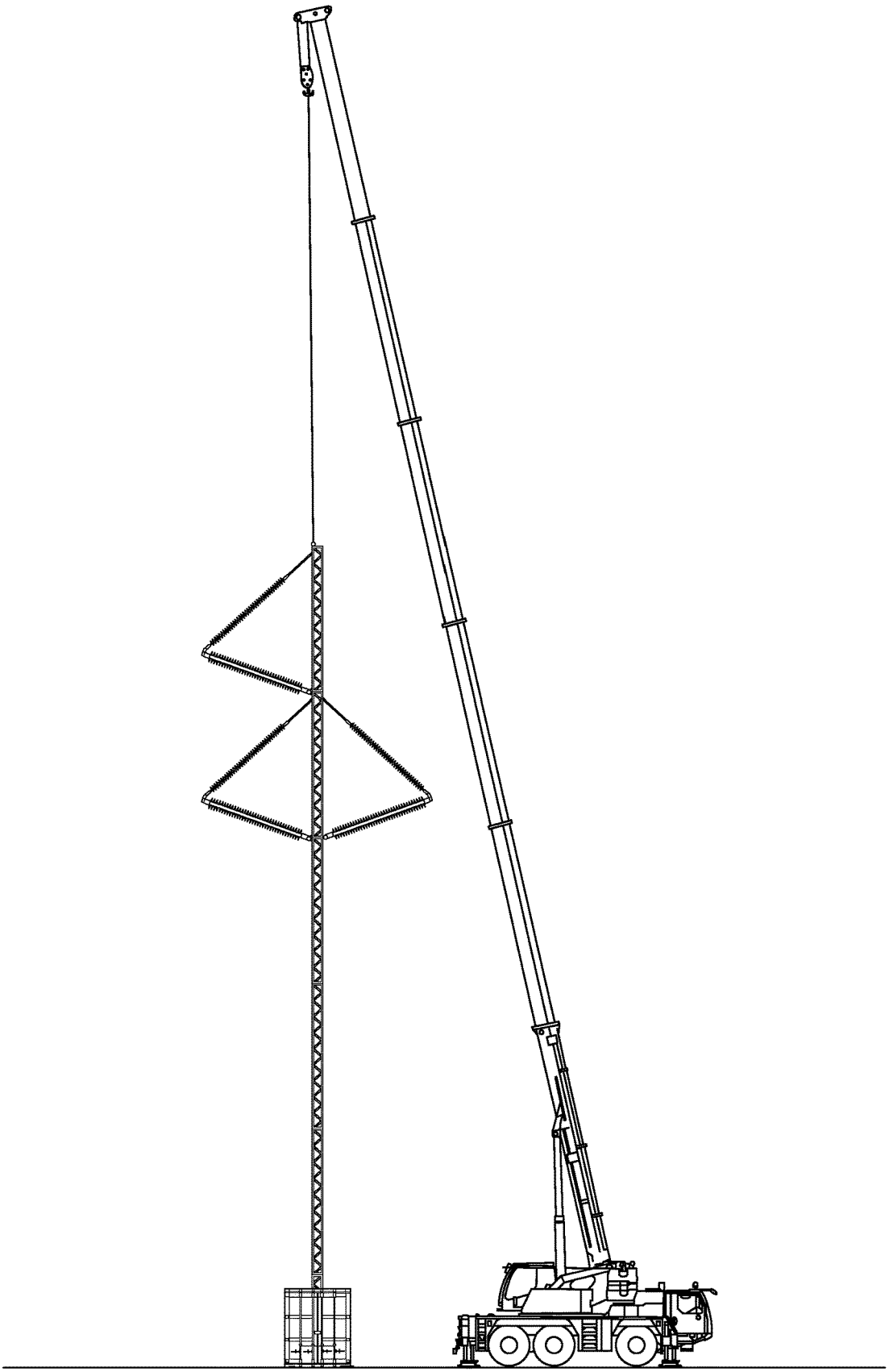
Figure 13:
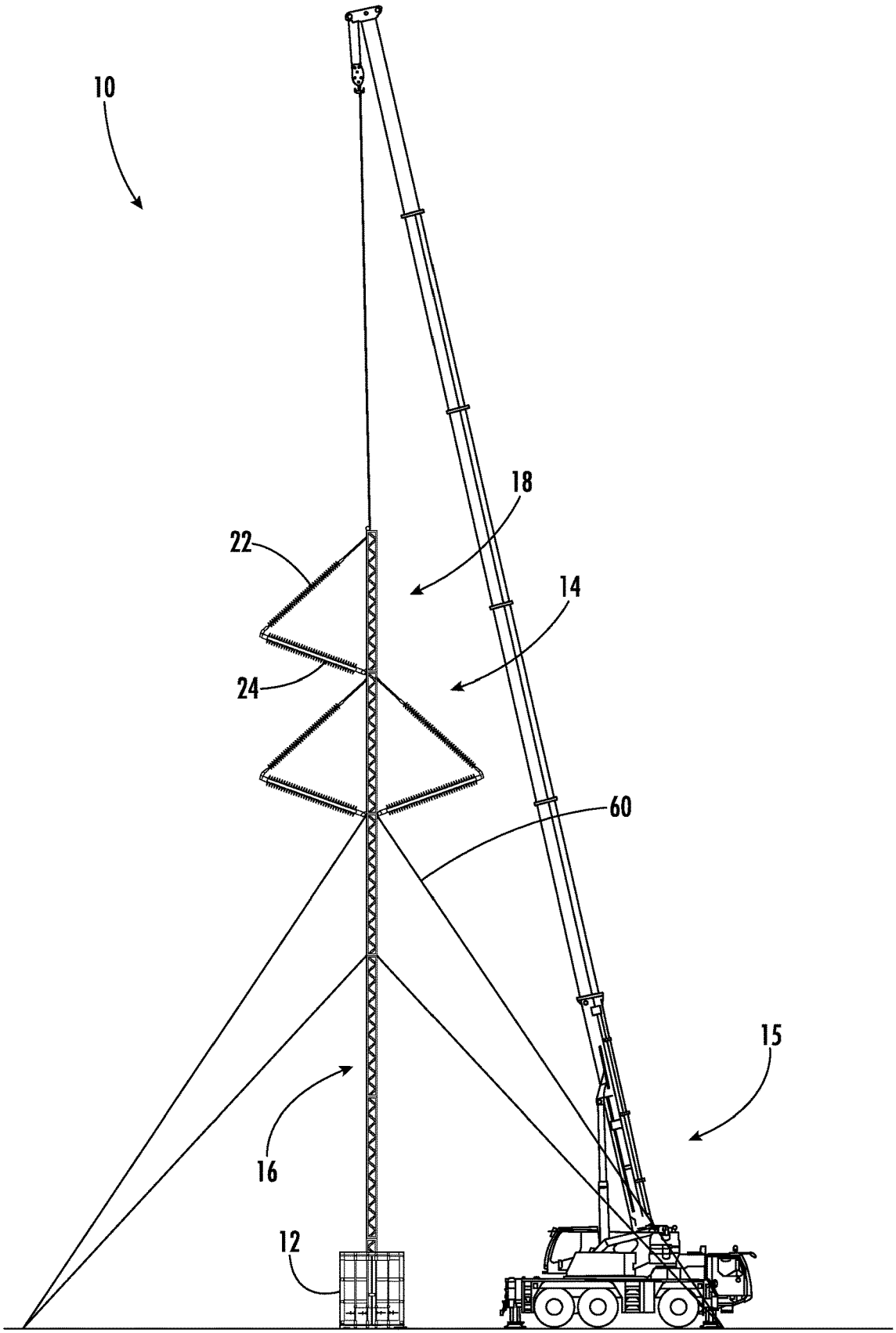

4. As the tower 14 is erected, insulators 22 and 24 may be deployed once the insulators 22 and 24 have been lifted above the base 12. The insulated tower section 18 may be shipped with the insulators 22 and 24 pre-installed in a collapsed form (see FIG. 5) to speed up erection of the tower 14. As shown in FIGS. 10 and 11, the insulators 22 and 24 are deployed by pivoting the insulators 22 and 24 away from tower section 16 until the free ends 30 and 32 meet. The free ends 30 and 32 are then connected together.

5. Once the tower 14 is erected and the insulators 22 and 24 have been deployed, the ERS 10 is then stabilized using stabilizers, such as cables 60 connected between the tower 14 and the ground. As shown, four cables 60 are used to stabilize ERS 10; however, it should be appreciated that the number of cables 60 used is determined by the height of the tower 14 and the local conditions.

In cases where taller versions are needed (more than 6 tower sections), two options are possible:

1. Ship the ERS 10 with eight tower sections pre-installed and perform the erection sequence as per the method outlined above. The only consideration associated with this method is the containers will not be stackable, since components will protrude from the base 12.

2. Where stackable containers are required, erection will take place in 2 stages, with the last 2 sections being pre-assembled at ground level and placed on top of the stack of masts prior to the extraction sequence.

The ERS 10 provides many benefits over existing systems.

1. ERS 10 is a fully complete, self-contained, collapsible, re-usable transmission tower that does not require individual components to be unpacked and re-assembled at the point of application.

2. Using the container as an integral part of the ERS 10 enables a significant increase in restoration speed, since the whole structure may be placed at the point of application, which eliminates the need to unpack, move and assemble components, and avoids the installation of a central foundation for the structure.

3. The use of self-locking tower sections provides an increase in erection speed.

4. The method does not rely on the use of guy anchors; thus, foundation installation is taken off the critical path, allowing anchors to be installed as a separate, parallel, independent activity, and enabling further reductions in erection time.

5. Optimized Electrical Design—While other ERS systems assume conventional insulation and conductor configurations, ERS 10 considers compacted configuration to enable the temporary energization at higher voltages. This electrical optimization will enable the use of shorter insulators, lighter conductors and reduced conductor bundle dimensions in comparisons to conventional ERS designs.

The foregoing has described an emergency restoration system and method. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends any novel one, or any novel combination, of the features disclosed in this specification (including any accompanying claims, abstract and drawings), or to any novel one, or any novel combination, of the steps of any method or process so disclosed.

What is claimed is:

1. A method of erecting an emergency restoration system, the emergency restoration system including a base and a tower formed of a plurality of tower sections and at least one insulating tower section, each of the plurality of tower sections being pivotally connected to an adjacent one of the plurality of tower sections and the at least one insulating tower section being pivotally connected to at least one of the plurality of tower sections such that in a stored position, the plurality of tower sections and at least one insulated tower section are stacked on the base and, in a use position, the plurality of tower sections and at least one insulated tower section form a linear, upright tower, comprising the steps of:

delivering the emergency restoration system to a location where the emergency restoration system is needed;

placing the base at the location;

using a lifting device to unstack and move the plurality of tower sections and at least one insulated tower section into the use position to form the linear, upright tower;

moving an insulator pivotally connected to the at least one insulated tower section to a use position; and stabilizing the tower in position.

2. The method according to claim 1, further including the step of locking adjacent ones of the plurality of tower sections together in a linear arrangement as the plurality of tower sections are lifted.

3. The method according to claim 1, further including the step of locking the at least one insulated tower section to an adjacent one of the plurality of tower sections in a linear arrangement as the at least one insulated tower section is lifted.

* * * * *